United States Patent [19]

Seufert

[11] Patent Number: 4,733,916

[45] Date of Patent: Mar. 29, 1988

[54] BENDING LINE ALONG OVERLAPPING LAYERS IN FOLDING BOX

[76] Inventor: Gerhard Seufert, Hans-Sachs-Strasse 3, 6054 Rodgau 5, Fed. Rep. of Germany

[21] Appl. No.: 877,898

[22] Filed: Jun. 24, 1986

[30] Foreign Application Priority Data

Jun. 29, 1985 [DE] Fed. Rep. of Germany ..... 3523416
Feb. 20, 1986 [DE] Fed. Rep. of Germany ..... 3605413

[51] Int. Cl.[4] ..... B65D 25/54

[52] U.S. Cl. ..... 229/162; 206/45.31; 206/45.34; 229/DIG. 4

[58] Field of Search ..... 229/162, DIG. 4; 206/45.31, 45.34; 220/82 R, 339, 377; 156/108; 493/905, 944; 428/167, 172

[56] References Cited

U.S. PATENT DOCUMENTS

| | | | |
|---|---|---|---|
| 1,288,132 | 12/1918 | Nagle | 229/DIG. 4 |
| 1,772,106 | 8/1930 | Miller | 229/DIG. 4 |
| 1,973,930 | 9/1934 | Rammer | 229/DIG. 4 |
| 2,558,918 | 7/1951 | Zinn, Jr. | 229/DIG. 4 |
| 3,186,574 | 6/1965 | Davidson | 220/339 |
| 3,199,670 | 8/1965 | Palmer | 206/45.34 |
| 3,245,526 | 4/1966 | Palmer | 206/45.31 |
| 3,301,143 | 1/1967 | Palmer | 493/944 |
| 3,792,809 | 2/1974 | Schneider et al. | 229/DIG. 4 |
| 3,907,193 | 9/1975 | Heller | 229/DIG. 4 |
| 4,064,206 | 12/1977 | Seufert | 220/339 |
| 4,268,555 | 5/1981 | Kantz | 229/DIG. 4 |
| 4,526,314 | 7/1985 | Reil | 229/DIG. 4 |
| 4,552,797 | 11/1985 | Munk et al. | 428/167 |
| 4,663,204 | 5/1987 | Langham | 428/167 |

FOREIGN PATENT DOCUMENTS

| | | | |
|---|---|---|---|
| 1436993 | 7/1969 | Fed. Rep. of Germany . | |
| 2507155 | 6/1981 | France . | |
| 2090230 | 7/1982 | United Kingdom | 206/45.31 |

*Primary Examiner*—Stephen Marcus
*Assistant Examiner*—Gary E. Elkins
*Attorney, Agent, or Firm*—Toren, McGeady & Associates

[57] ABSTRACT

In a folding box consisting of a cardboard blank part (1) and a plastic foil blank part (3) glued thereto, thinned-down areas (17) are placed in the foil blank part (3) at the overlap spots between the two blank parts in the area of the box edges, which directly adjoin the bend lines (13) and extend at least across the overlap length. The thinned-down areas (17) compensate stresses arising in the foil material at the overlap spots during folding, this compensation being by deformation, without which the cardboard material is stretched at the edge overlap spots so that it tears.

24 Claims, 19 Drawing Figures

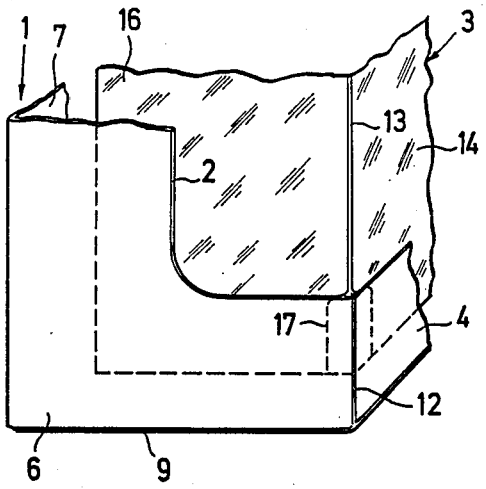
FIG. 10
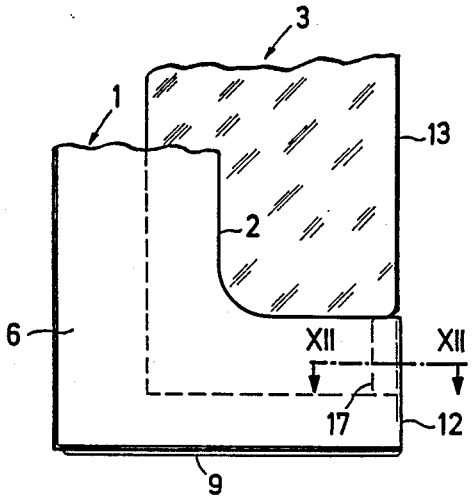
FIG. 11
FIG. 12
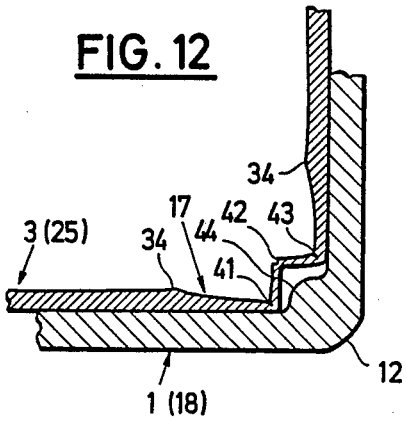

BENDING LINE ALONG OVERLAPPING LAYERS IN FOLDING BOX

BACKGROUND OF THE INVENTION

1. Field of the Invention

The invention is directed to a folding box, consisting of a first cut-to-size blank from non-transparent material, particularly cardboard, and a second cut-to-size blank from transparent stiff plastic foil, which extends over at least one box edge which, in one portion, is constituted by a bending line provided in the plastic foil, and which is glued with the first cut-to-size blank overlapping on its inside; an overlap between the first and second cut-to-size blank exists also at at least one end of the bending line and the bending line is continued in the first cut-to-size part by a corresponding groove line, at which the box edge to the other part is formed.

2. Description of the Related Art

Such folding boxes consisting of differing materials are known in different embodiments. In a known window folding box, the cardboard cut-to-size part has an aperture constituting a viewing window, which is sealed by a leaf of stiff plastic (DE-OS No. 31 48 443). In another known folding packing (DE No. 31 53 240 of the International Application WO No. 82/00449), not only is a viewing window in the cardboard blank provided, but a plurality of walls or wall portions connected with each other by box edges possibly including adjacent sealing flaps and dust strips are fabricated completely from a plastic part.

In the two box types described above, overlaps between the two blanks consisting of differing materials exist at the end of bending lines formed in the plastic blank, or can exist in the previously described folding packing.

These points of overlap cause difficulties during folding, since, because of the double material thickness at the points of overlap, material displacement and material stretching can occur. Since the plastic blank rests on the inside of the cardboard blank, the plastics foil is crushed during folding in the area of the groove line of the cardboard blank, while the cardboard is simultaneously stretched in such a way that its outer layer or liming can tear along the groove line. The folding at such overlap points can be performed mechanically only in an unsatisfactory manner.

It is provided for avoidance of the previously described difficulties in an additional known folding container with window (DE-OS No. 14 36 993), that recesses are provided in the window foil edge in the area of the bending line, while tangs or fingers are provided at the cardboard blank which overlap these recesses. Since the overlapping surfaces at the fingers and the window foil are free of glue in this area, a displacement between these surfaces during folding is possible without the occurrence of stresses. At the same time the folding container does not become leaky at the recesses, since the tangs cause a covering in the area of the container edges. The tangs or fingers existing in this known folding container, however, not only considerable limit the shaping possibilities of the container, but also render the mechanical folding more difficult, because they bend outwards during the folding process and thus form undesirable protrusions.

In the previously mentioned known window folding box (DE-OS No. 31 48 443), it is provided that the above-mentioned recesses or notches extend at least up to the edge of the window opening. Because of the more or less large apertures thus formed between the cardboard blank and the plastics leaf in the area of each overlap spot at the box edges, material displacement in these difficult areas should not occur during the folding process. The existence of apertures at folding box edges is, however, not acceptable for all applications of packagings of this type.

SUMMARY OF THE INVENTION

The present invention provides a folding box of the previously discussed species, in which neither outwardly projecting tangs nor apertures exist at the overlap spots in the area of the folding box edges and which, in spite of that, can be mechanically folded without difficulty also at these overlap spots. The task thus defined is solved in the invention, in that at the overlap spots between the first and the second blank existing in the area of the box edges, the second blank is thinned down in a shaped manner to a fraction of its original foil thickness directly adjacent to the bending lines, and that the thinned-down areas of the second blank extend at least over the overlap length.

These measures result in a complete stress equalization at the explained difficult areas of the overlap spots located at the box edges, because the thinned-down areas are easy to deform under the action of the upsetting forces generated during folding. These deformations, which essentially occur as small creases exclusively in the area of the thinned-down areas, are located on the inside of the groove lines of the cardboard blank and therefore are not observable in an undesirable fashion from the outside. If the thinned-down areas are dimensioned in such a manner that they extend only over the overlap length or possibly are slightly larger, meaning that they do not protrude at all, or only slightly, beyond the cardboard edge, a smooth and continuous edge without interruptions is obtained when folding the box edge involved, which contains neither holes nor steps at those points where the two different materials abut which would be visible from the outside.

The thinned-down areas appropriately exhibit an essentially constant cross-section across their length. Thus a uniform stress equalization over their length is achieved in the form of continuous small creases, if the folding box is folded at the edges involved, that is, when it is errected from its flat collapsed position.

The thinned-down areas comprise, advantageously, a diminishing thickness starting from their side edges towards the center, wherein the thickness is smallest in the area of the groove lines in the first blank. The deformability of the thinned-down areas along the groove lines of the first blank is largest because of these measures, wherein the formation of small creases equalizing the stress is favored.

The thinned-down areas, which naturally are produced in the plastic foil blank prior to its being united with the cardboard blank by gluing, can be produced by action on the plastic foil from both sides. Preferably, however, they are produced by action only on one side of the plastic foil, while the plastic foil part is resting on a flat surface.

Especially suitable thinned-down areas for the task provided are achieved if these are produced together with the fold lines by high frequency-/pressure action or by hot stamping Attention has to be paid when forming the thinned-down areas so that no interfering migration beads, consisting of plastics material, are generated at the side edges of the thinned-down areas, so that a gluing with a cardboard blank is also possible on that foil side at which such migration beads could be formed.

Pursuing the inventive thought, the thinned-down areas can be differently shaped while retaining the same, or nearly the same, effectiveness. Preferably, the thinned-down areas are bounded on one side in an arc-shaped manner viewed in cross-section. They can, however, also be bounded on one side respectively by at least two abutting inclined planes. Another possibility consists in that the thinned-down areas are bounded on one side, respectively, by two outer inclined planes and one central flat plane. Finally, an embodiment is also possible in which they are bounded on one side by flat faces arranged in a step-shaped manner.

It is provided in a preferred embodiment of the folding box that, respectively, three parallel grooves are molded spaced equally within the thinned-down areas, the central groove being arranged in direction of extension of the appropriate bending line in the second blank. These fine grooves create intended folding points, at which small uniform wrinkles are generated when folding the folding box, which take care of the required stress equalization and which extend parallel to the neighboring groove lines in the first blank.

It is advantageous here if the central groove follows directly upon the bend line, and the two side grooves extend, respectively kinked at their inner ends and unite with the central groove at the junction point to form the bend line. Because of this groove configuration, the stresses occurring during folding of the box also at the transition between the bend line in the plastic foil and the thinned-down area, are compensated by a roof-like deformation of the small surface areas of the thinned-down area bounded by the three converging grooves.

Particularly good results are achieved in the formation of small predetermined wrinkles in the overlapping edge area if the central groove is pressed into the thinned-down foil up to a smaller foil residual thickness than the two side grooves, which are pressed in up to an equal foil residual thickness.

With a thickness of between 200 μm and 400 μm of the plastic foil used for the second blank, it has been shown to be advantageous if the minimum thickness in the region of the thinned-down areas amounts to about 100 μm.

It is appropriate for achieving good folding at the critical edge overlapping zones of the two differing materials, if the foil residual thickness at the central groove amounts to about one-third and the foil residual thickness of the two side grooves to about two-thirds of the minimum thickness in the region of the thinned-down areas.

It is advantageous for the desired formation of small wrinkles from the thinned-down areas along the groove lines in the cardboard blank, if the overlap gluing between the two blankds ends approximately at the side edges of the thinned-down areas. During the placement of the three parallel grooves within the thinned-down areas for the formation of such predetermined wrinkles, one has to pay attention that the overlap gluing between the two blanks ends at the side grooves.

Good results are also achieved if the thinned-down areas comprise, respectively, one central strip covering the associated groove line of the first blank and following upon the associated bend line of the second blank; said central strip has a constant foil residual thickness at all points and is adjoined in a stepless fashion by transition planes which are arched in concave manner on the sides and which reach up to the side edges. If in this case the central strip has a foil residual thickness of approximately 40 to 60 μm with a thickness of the plastics foil used for the second blank of approximately between 200 and 400 μm, while its width amounts to about $\frac{1}{3}$ to 1/6 of the width of the thinned-down area, particularly good results are achieved.

A folding box designed according to the invention can be folded without problems, during box erection, at the overlapping places located at the box edges defined by the groove lines in the first blank and the bend lines in the second bank aligned with said groove lines; this without the cardboard material of the first blank tearing in the zone of the groove lines and also without interfering deformation of the plastic foil constituting the second blank appearing in an area open to view. Herein, all stresses arising during the folding operation are compensated by the thinned-down areas existing at the overlapping places.

Due to the manufacturing tolerances, above all during gluing of the two blanks, displacements of the thinned-down areas with respect to the first blank can occur under certain circumstances, which at the boundary between the visible area and the overlapping places can lead to residual stresses not completely compensated by the thinned-down areas, particularly when thicker plastic foils of roughly 400 μm thickness are utilized. In order to be able to also remove residual stresses of this kind, should this be required in order to eliminate the stress effects on the cardboard material and the foil visible zones adjacent to the overlapping places, it is proposed according to a further refinement of the invention, that at the junction place between the bend lines and the thinned-down areas in the second blank, respectively, one interruption be provided which is continuous throughout the material thickness, and which, in essence, is not overlapped by the first blank.

It has been shown that all possible residual stresses at the boundaries between the visible area and the cardboard zone can be absorbed by such breaks; this alleviates the possibility of the cardboard tearing at the cardboard boundary as well as warping of the adjacent foil regions. In its simplest form sufficient for most of applications, the break is made advantageously to be a line-shaped incision extending transversely to the bending line, which incision projects on both sides beyond the bend line, has approximately the width of the thinned-down area, and extends parallel to the closely adjacent edge of the first blank. The incision can hardly be seen from the outside and does not constitute a hole worth mentioning in the foil material even in the erected state of the box.

In cases where it is relatively unimportant whether any holes are formed at the box edge in the visible area, an arrangement can be made, according to a further embodiment of the invention, in such a way that the break is designed as a hole cutout which projects, at both sides, beyond the bend line with surface areas corresponding approximately to each other and whose width corresponds to approximately the width of the thinned-down area.

Particularly favorable stress equalization results are achieved by this method if the hole cutout is designed to be circularly-shaped in the flat resting second blank or if the hole cutout in the flat resting second blank exhibits approximately the shape of an ellipse, whose longer axis extends parallel to the adjacent edge of the first blank.

BRIEF DESCRIPTION OF THE DRAWINGS

The invention is described with particularity in the following with the help of drawings illustrating the embodiment examples, in part, schematically, wherein:

FIG. 10 is a perspective view of a window corner of the glued, erected and closed window folding box according to FIG. 1;

FIG. 11 is a partial side view of the folding box illustrated in FIG. 10;

FIG. 12 is a cross-sectional magnified view of the folding box taken along the line XII—XII in FIG. 11;

DESCRIPTION OF THE PREFERRED EMBODIMENTS

In the magnified illustrations in the FIGS. 5 to 9, 12 and 13, the thickness dimensions are shown considerably more magnified than the width dimensions for reasons of clarity.

Figure 1:
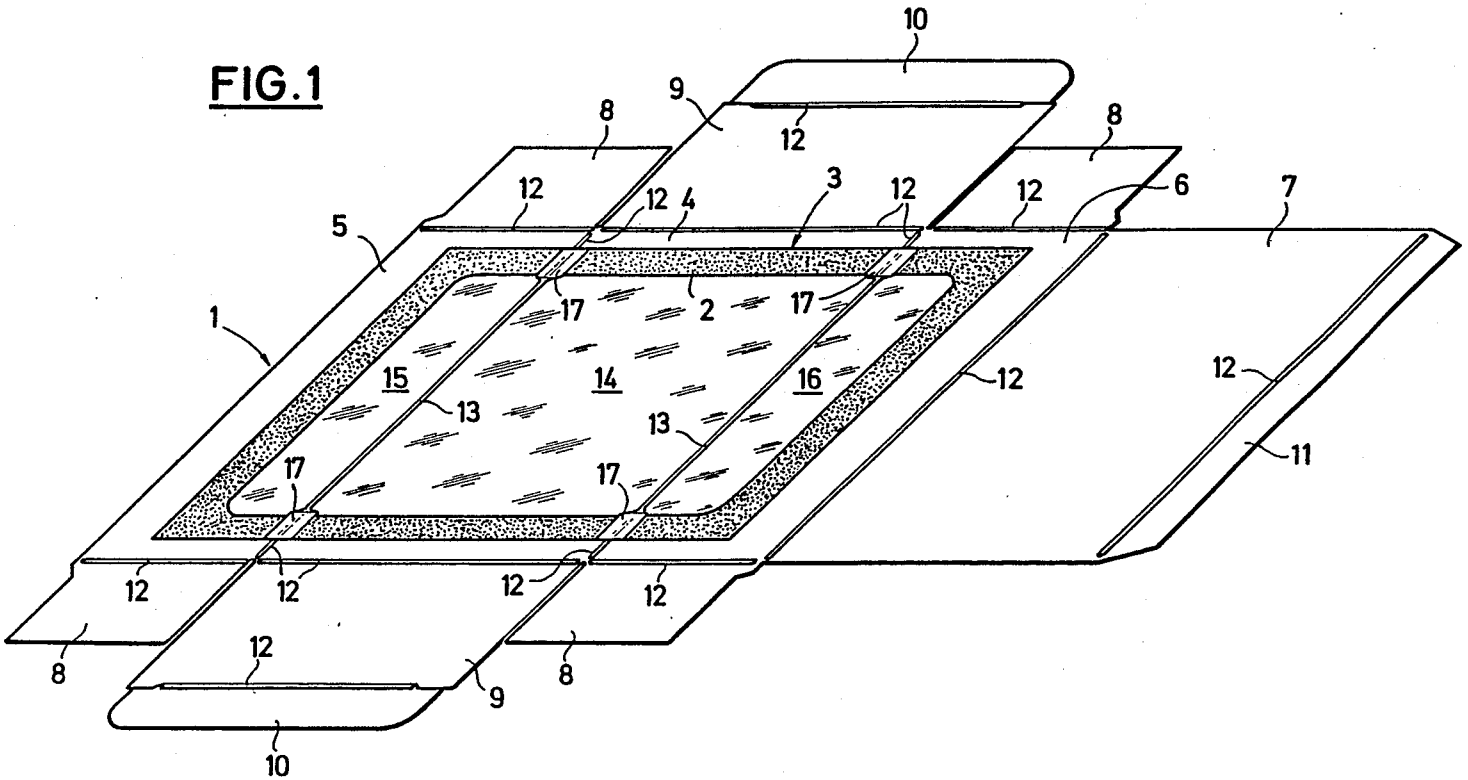
FIG. 1 is a perspective view of a window folding box blank consisting of two parts glued to each other.

FIG. 1 shows a typical blank of a window folding box, which is composed of a first blank portion 1 of cardboard defining the outer contour of the blank and a second blank portion 3 from transparent stiff plastic foil covering a window opening 2 in the cardboard blank portion in an overlapping manner. The blank results, after gluing, erection and sealing on both sides, in a cube-shaped window folding box, whose window opening 2 extends across its front wall 4 and across partial regions of the side walls 5 and 6 adjacent thereto. The rear wall 7, adjacent to the side wall 6, is part of the cardboard blank portion 1 as well as four dust tabs 8 connected to the side walls 5 and 6, and the sealing tabs 9 connected to the front wall 4. Insert tabs 10 are connected to the sealing tabs 9. A gluing tab 11 is provided at the rear wall 7 for gluing together of the blank into a compact box jacket, the external face of gluing tab 11 being glued to the inside face of the side wall 5. At the interfaces between previously mentioned portions of the cardboard blank portion 1, groove lines 12 are pressed into the cardboard, which in turn, form the box edges after gluing, erecting and closing of the folding box.

Figure 3:
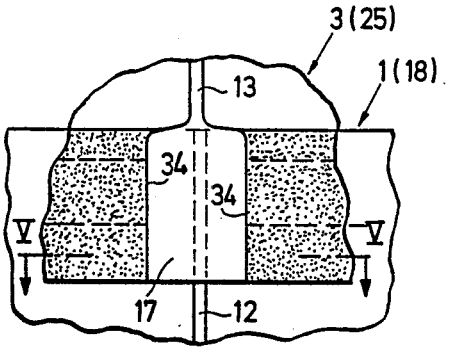
FIG. 3 is a partial magnified plan view of an ovelapping place with a thinned-down area arranged in the plastic material blank, in a flat resting position.
Figure 4:
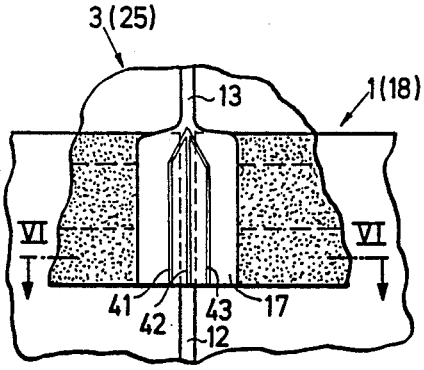
FIG. 4 is a plan view similar to FIG. 3 with parallel grooves formed in the thinned-down area.

The foil blank 3 is glued to the inside surfaces of the front wall 4 and the side walls 5 and 6 so as to overlap the window opening 2 on all sides in a frame-like manner. The frame-like overlapping surface is indicated in FIG. 1 with dots. The same applies to FIGS. 2–4. Naturally, the entire overlapping surface is not required for gluing the two blank parts 1 and 3 together. The application of glue can be limited to a relatively narrow strip, which, in FIGS. 3 and 4, is indicated as being bounded by broken lines.

The foil blank 3 is divided by two fold lines 13 into a front wall portion 14 and two side wall portions 15 and 16. The fold lines 13 are continued by aligned groove lines 12, which are located between the front wall 4 and the side walls 5 and 6 of the cardboard blank 1. Two box edges are formed at these groove lines and the fold lines 13 which are exactly aligned therewith when the folding box is erected.

Thinned-down areas 17 in the foil blank 3 are provided respectively at four overlap points between the two blank portions 1 and 3 in the area of the two previously mentioned box edges; said thinned-down areas will be explained with particularity hereinafter.

The invention is basically applicable to all types of folding boxes and other foldable packaging units, as for instance foldable slip-on covers; this to the extent that overlap between cardboard and plastic foil occurs in the area of box edges. In order to illustrate, to that extent, the universal utilizability of the invention, a type of folding box considerably deviating from the window folding box according to FIG. 1 is shown as a blank in FIG. 2 with the help of its blank. Here we are delaing with a folding box which has the approximate shape of a cube after gluing, erecting and closing on both sides. Here no window opening is provided in the first blank 18 consisting of cardboard. Rather, the second blank 25, fabricated from transparent stiff plastic foil, constitutes, with its external outline, a portion of the overall blank, so that complete wall surfaces, or wall surfaces continuous throughout one box edge length, consisting of transparent plastic foil are formed in this folding box.

The first blank 18 comprises the rear wall 19, two half side walls 20, 21, a smaller sealing flap 22, a larger sealing flap 23 and four half dust tabs 24. The foldability between these parts is again made possible by the groove lines 12 pressed into the cardboard.

The second blank 25, fabricated from transparent stiff plastic foil, comprises the front wall 26, two side wall parts 27, 28, a larger sealing flap 29, a smaller sealing flap 30 and four dust tab parts 31 connected to the side wall parts 27, 28.

The foldability of the described foil parts is again assured by the bend lines 13 located in the foil. Insert tabs 32 are located at the sealing flaps 29, 30, which engage slits 33 when the folding box is closed; said slits 33 are located in the sealing flaps 22, 23 of the cardboard blank part 18. As is evident, the sealing flaps 22 and 29, on the one hand, and the sealing flaps 23 and 30, on the other hand, interact when the folding box is closed. Since the smaller sealing flap 22 of the cardboard blank part 18 is only half as large as the sealing flap 23 constituting the box base, the upper box closure also permits a view inside of the box because of the transparent sealing flap 29.

Figure 2:
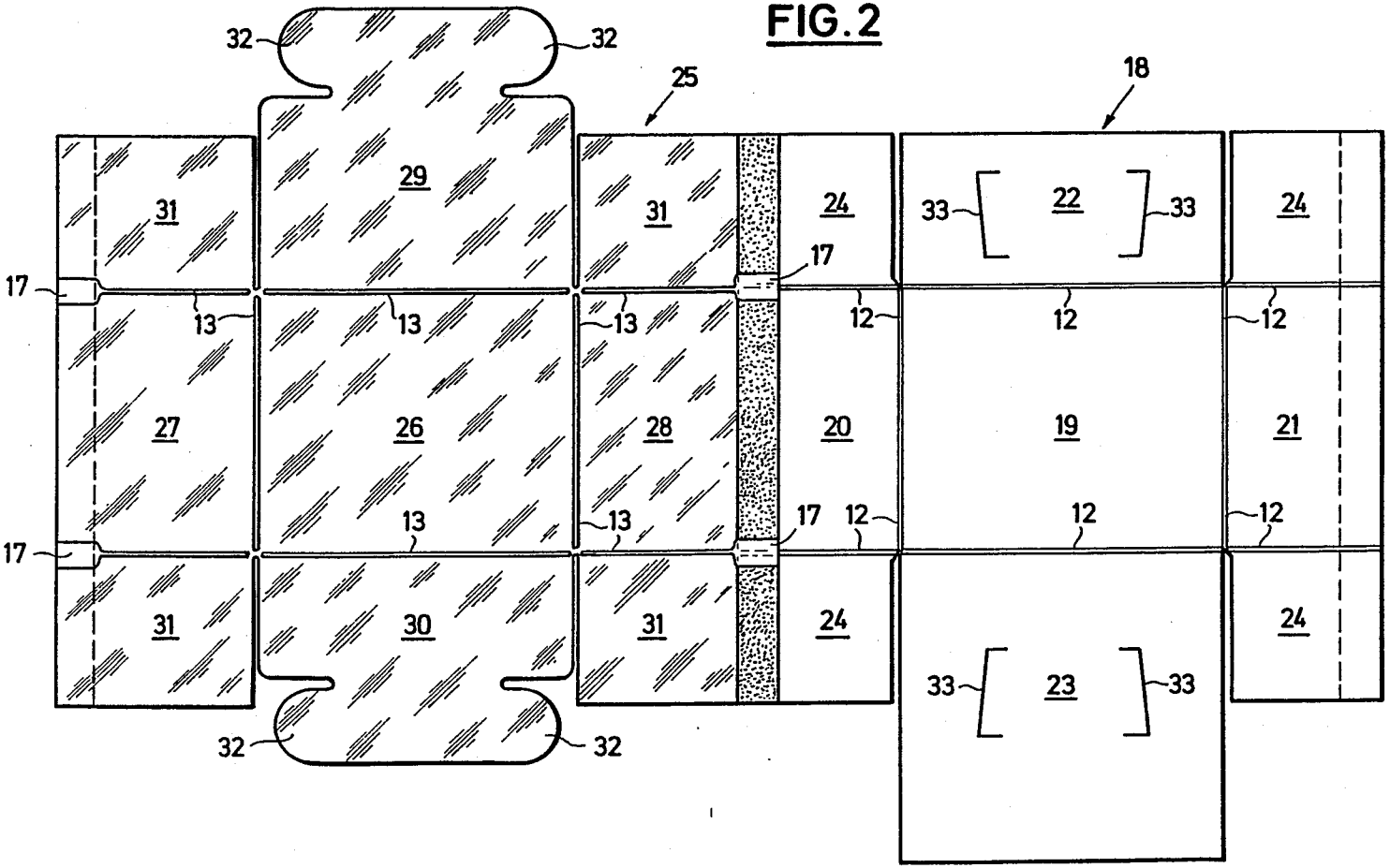
FIG. 2 is a plan view of a blank consisting also of two parts glued to each other of another folding box type.

As FIG. 2 furthermore shows, the two blank parts 18 and 25 are glued to each other so as to overlap, which is indicated by the dotted surface area. Herein, the portions of the foil blank 25 which are designed to be larger, as far as the area is concerned, namely, the side wall portion 28 and the two connected dust tab portions 31, overlap the corresponding portions 20 and 24 of the cardboard blank part 18. The gluing between the two blank portions occurs in the dotted surface area on the insides parts 20, 24. Correspondingly, the half of the side wall 21 and the half dust tabs 24 connected thereto of the cardboard blank portion 18 are glued in an overlapping fashion to the side wall part 27 and the dust tab parts 31 connected thereto of the foil blank portion 25. The overlap limits are indicated in FIG. 2 by means of two broken lines.

Also in the case of this folding box, overlap points in the area of the four box edges are located in the two existing overlap areas of the two blank portions 18 and 25, at which respectively, one bend line 13 is continued in a precisely aligned manner by a groove line 12. At these overlap points, four thinned-down areas 17 in the foil material of the foil blank portion 25 are again provided in accordance with the invention. The design and arrangement of the thinned-down areas 17 is now explained with particularity.

In this connection, reference is made, first of all, to the FIGS. 3 and 4, in which, respectively, one single overlap point between the cardboard blank portion 1 or 18 and the foil blank portion 3 or 25 is shown. As can be seen, the groove line 12 in the cardboard blank portion is exactly aligned with the bend line 13 in the foil blank portion, so that a folding edge of the box is formed during the folding process which passes in a straight line through both materials. In the region of this box edge, the foil blank portion 3 (25) includes the thinned-down area 17, which extends across the entire overlap length and slightly beyond. The thinned-down area 17 comprises an approximately rectangular outer periphery, the longer central axis of which coincides with the groove line 12 and the bend line 13.

As can be seen from the schematic sectional illustrations of the FIGS. 5 to 9, the blank portion 3 (25) is thinned-down to a fraction of its original foil thickness in the region of the thinned-down area 17, wherein the thickness is smallest in the center of the thinned-down area 17, i.e. in the region of the groove line 12. The cross-sectional formations of the thinned-down areas 17 illustrated in FIGS. 5 to 9 extend essentially over the length of the areas 17. Furthermore, it can be seen from the FIGS. 5 to 9 that the thinned-down areas 17 diminish in thickness starting from their side edges 34 towards the center thereof. The reduction in thickness differs in the embodiments shown.

At the side edges 34 of the thinned-down areas 17 small beads are indicated in the FIGS. 5 to 9 and 12, which occur due to material migration from the thinned-down area during the fabrication of the thinned-down areas. The dimensions of these beads can be held within limits by means of suitable measures, so that they do not interfere even if the foil blank portion 3 (25) is glued together with the cardboard blank portion 1 (18) on the side carrying the beads. In the example according to FIG. 12, the surface of the foil blank portion not comprising the beads is glued to the cardboard blank portion.

Figure 5:
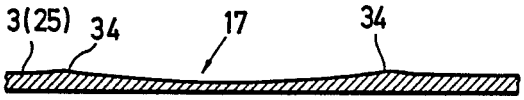
FIG. 5 is a cross-sectional view of the plastic material blank taken along the line V—V in FIG. 3.
Figure 6:
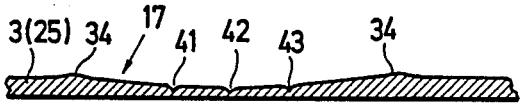
FIG. 6 is a corresponding cross-sectional view of the plastic material blank taken along the line VI—VI in FIG. 4.
Figure 7:
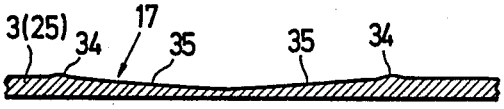
FIGS. 7 to 9 and 13 are cross-sectional views similar to those in further embodiment shapes of the thinned-down areas.
Figure 8:
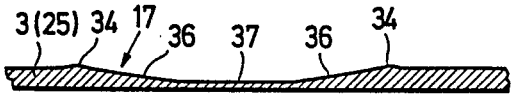
Figure 9:
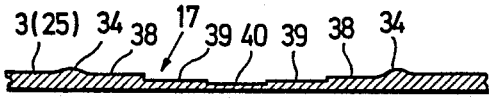

The thinned-down area 17, viewed in cross-section, can be bounded on one side in an arch-shaped manner as is illustrated in the FIGS. 5 and 6. In the example according to FIG. 7 the thinned-down area 17 is bounded on one side by two inclined planes 35 meeting in the center. An embodiment shape is illustrated in FIG. 8, in which the thinned-down area 17 is bounded on the one side by two outer inclined planes 36 and a central flat plane 37. FIG. 9 finally illustrates an embodiment of the thinned-down area 17 including flat surfaces 38 to 40 arranged in a step-shaped manner on one side of the foil. In each of the embodiments according to the FIGS. 5 to 9, the thickness of the thinned-down area decreases from the side edges 34 towards the middle.

The border surface profilings of the thinned-down areas described above are achieved by an appropriate design of the tool provided for fabrication of the thinned-down areas. The application of the thinned-down area 17 can occur simultaneously with the placement of the bend lines 13 in one work process, and indeed with the help of processes for the application of the bend lines. High frequency heating with the simultaneous application of pressure is principally used for this purpose, by means of which particularly pliable soft bend edges are generated. Usable results are, however, also achieved by simultaneous hot stamping of the thinned-down areas 17 and the bend lines 13. Herein, the fabrication of the thinned-down areas as well as the bend lines 13 occurs appropriately by action on one side of the plastic foil. The application of the bend lines 13 with the high frequency process (DE-PS No. 25 41 324) as well as with the hot stamping process are so well known, that they do not require any further explanation at this time.

If the folding of the overlap points for formation of a box edge in an embodiment of the thinned-down area 17 occurs according to one of the FIGS. 5 and 7–9, then small wrinkles occur essentially along the groove line 12 caused by the material upsetting in the region of the thinned-down area 17 in direct proximity of the groove lines 12 of the cardboard blank portion 1 (18); this completely compensates the upsetting stresses in the foil in the overlap region of the box edge. The described process for formation of the small wrinkles can be additionally considerably promoted, if three parallel grooves equally spaced from each other are molded within the thinned-down areas 17, as shown in the examples in FIGS. 4 and 6. The molding of these small grooves occurs simultaneously with the fabrication of the thinned-down areas 17 and the bend lines 13. As can be recognized in the example according to FIG. 4, the central groove 42 follows directly the bend line 13, while the two side grooves 41 and 43 are kinked at their inner ends and unite with the central groove 42 at the junction point with the bend line 13. If the thus formed thinned-down area 17 is deformed during folding of the folding box edge concerned, then intended folds defined along the grooves 41 to 43 are formed, as is illustrated in FIG. 12 in a greatly magnified manner. Because of this, the overlap area considered here is not only folded in a particularly easy manner, but a defined foil deformation in the thinned-down area is generated during the stress compensation with the successful equal appearance of all overlap areas in the box edge area after the erection of the folding box.

FIG. 12 illustrates the typical formation of a bead 44 lying inside in the region of the groove line 12 in the cardboard blank section 1 (18). As is evident, the surface zones of the thinned-down areas located between the grooves 41 to 43 rise in a roof-shaped manner from the bead 44 when the defined predetermined folds are formed; this happens if parallel grooves 41 to 43 are placed in accordance with FIG. 4 and 6. The extent of this roof-shaped predetermined folding generated inwards however diminishes in the inner end zone of the grooves 41 to 43, in which the grooves converge towards the junction point at the bend line 13; this phenomenon causes again an approach of the foil material towards the bead 44. The predetermined fold formation therefore does not lead to the formation of holes in the edge transition region between the folded bend lines 34 and the groove lines 12, as is illustrated in the FIGS. 10 and 11.

As can be seen in FIGS. 10 and 11, it is not necessary that the inner end region of the thinned-down area 17 projects essentially beyond the cardboard edge. In spite of that all the stresses arising during folding are compensated by the thinned-down area 17 in such a way, that neither a perturbing deformation of the foil in the visible region nor a tearing of the cardboard material in the zone of the groove line 12 occurs. Bend line 13 and groove line 12, rather, constitute a smoothly continuous box edge, which is also nearly free of steps at the transition point between the carton and the foil in the edge region. The folding box thus meets all requirements including aesthetic ones.

The placement of parallel grooves 41 to 43 was only described with reference to an arc-shaped delimitation of the thinned-down area 17, however the thinned-down area 17 can also be provided with grooves 41 to 43 corresponding to the embodiments illustrated in FIGS. 7 to 9. A particularly favorable easy foldability in the region of the grooves 41 to 43 results if the foil residual thickness of the central groove 42 is smaller than that of the two corresponding side grooves 41 and 43.

If stiff plastic foils are used for the fabrication of packagings, particularly folding boxes, foil thicknesses are utilized which lie in the region between 200 and 400 μm. For this thickness range, it has been found to be advantageous if the thinned-down areas 17 are formed in such a way that the minimum thickness of the central region of the thinned-down areas amounts to approximately 100 μm. The placement of grooves 41 to 43 reduces the minimum thickness at the grooves considerably. One obtains good results if the central groove 42 results in a foil residual thickness of approximately 30 μm, while the foil residual thickness at the two side grooves 41 and 43 amounts to approximately 60 μm.

Figure 13:
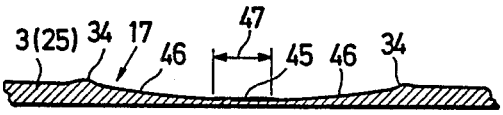

In the embodiment illustrated in FIG. 13 depicting the cross-sectional shape of the thinned-down area 17, we are also dealing with a schematic sectional presentation. Previous statements dealing with the embodiment examples in FIGS. 5 and 9 apply also to FIG. 13 to the extent that no deviating statements are made in the following text. Thus, the additional placement of parallel grooves 41 to 43 according to FIG. 4 is not provided for the embodiment in FIG. 13. In addition, the above statements concerning the minimum thickness in the central region of the thinned-down areas do not apply.

As is recognizable, a flat central strip 45 is located in the thinned-down area 17, the width of which is indicated by the dimension lines given the reference number 47. This central strip 45 extends across the entire length of the thinned-down area 17 and covers the assigned groove line 12 in the cardboard blank portion when the foil blank portion 3 (25) is joined with the cardboard blank portion 1 (18). Since the central strip 45 extends across the entire length of the thinned-down area, it is directly contiguous to the associated bend line 13 in the foil blank portion 3 (25). The central strip 45 has a very small constant foil residual thickness of 40 to 60 μm throughout. Good folding results are achieved with a residual thickness of 55 μm. The small foil residual thickness indicated applies to a thickness of plastic foil of between 200 and 400 μm which is to be used for the foil blank portion 3 (25). The width 47 of the central strip 45 lies between one-third to one-sixth of the width of the thinned-down area 17, which can amount to approximately 8 mm. A corresponding width of 8 mm for the thinned-down area 17 is also sufficient for the examples described previously. Good results were achieved with a width of the central strip 45 of between 1.5 and 2 mm.

Transition surfaces 46 arched in a concave manner adjoin the central strip 45 on both sides in a stepless fashion; said transitional surfaces 46 terminate at the side edges 34 of the thinned-down area 17. When folding the glued-together blanks, it has been shown that the desired small wrinkles occur in the region of the central strip if the cross-sectional shape is according to that shown in FIG. 13; this results in an approximate configuration as shown in FIG. 12, even if the glue between the two blanks is not interrupted at the thinned-down areas 17. In this case micro wrinkles form which, in actual practice, rest tightly at the bead 44.

Figure 14:
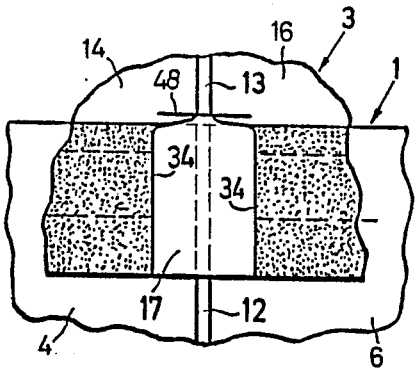
FIG. 14 is a partial and magnified inside view of an overlapping place of a folding box blank composed of two blanks in a flat resting position with a first embodiment of a break.
Figure 15:
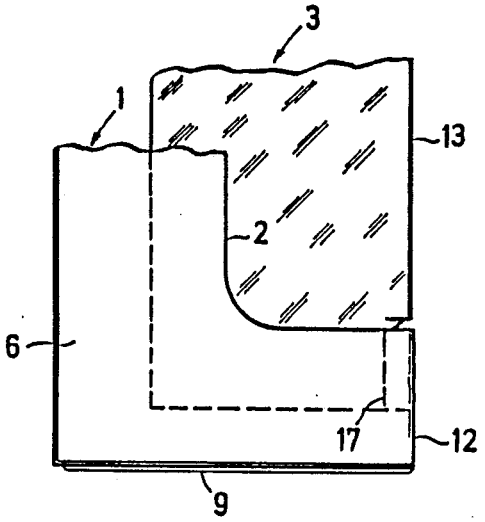
FIG. 15 is a partial side view of the folding box erected from the folding box blank according to FIG. 14.
Figure 16:
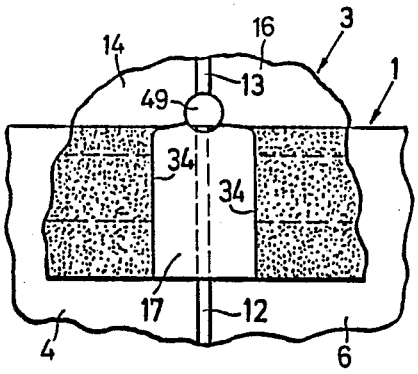
FIG. 16 is an inside view of an overlapping place of a folding box blank similar to FIG. 14, with a second embodiment of the break.
Figure 17:
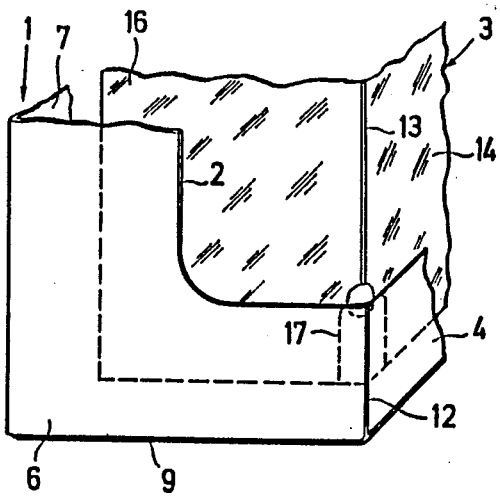
FIG. 17 is a partial perspective view of the folding box erected from the folding box blank according to FIG. 16.
Figure 18:
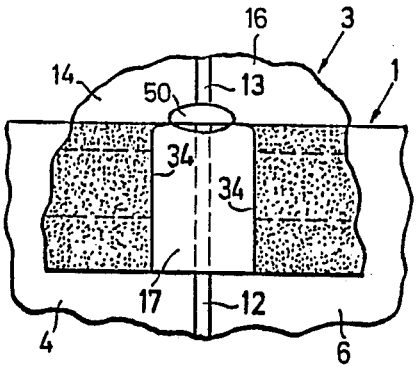
FIG. 18 is an inside view of an overlapping place of a folding box blank similar to the FIGS. 14 and 16 with a third embodiment form of the break.

The overlap spots depicted in truncated form in the FIGS. 14, 16 and 18 can basically be designed in all known types of folding boxes as illustrated in said figures, provided they are composed out of a first blank portion 1, which, for instance, is constituted by cardboard and a second blank portion 3 from transparent thick plastic foil. Such composites of folding boxes can be designed resembling a window folding box, as indicated by window openings 2 in FIGS. 15, 17 and 19 at a comparatively smaller scale, or they can comprise a larger plastic material part compared to a window folding box, which extends across several wall portions possibly including adjacent sealing flaps and dust tabs. The folding boxes considered here have, in common, the overlap between the cardboard blank part 1 and the foil blank part 3, wherein both blank parts are glued together, and indeed the cardboard blank part 1 on its inside and the foil blank part 3 on its external side. The overlapping gluing is indicated in a dotted manner in the FIGS. 14, 16 and 18 and does not have to extend across the entire overlap area. The gluing can also be executed in a strip-shaped manner, as it is indicated in the above-named figures by the broken lines extending parallel to the edges of both blank parts 1 and 3.

Figure 19:
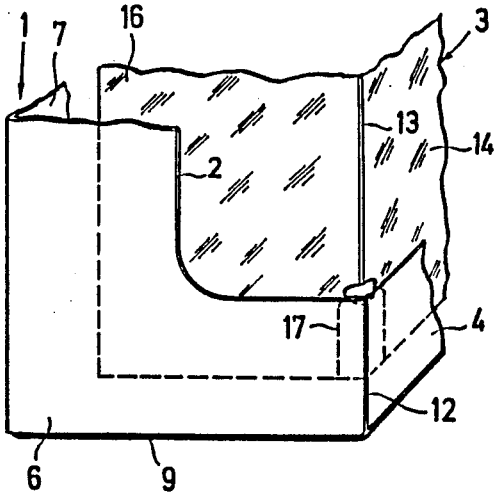
FIG. 19 is a partial perspective view of the folding box erected from the folding box blank according to FIG. 18.

In case of the window folding box depicted in the FIGS. 15, 17 and 19, the foil blank part 3, and with it also the window opening 2, extend across at least two abutting wall surfaces of the folding box, namely, across the front wall 4 and the side wall 6 in the illustrated embodiment. Accordingly, the foil blank part 3 comprises a front wall portion 14 and a side wall portion 16, which abut at the bend line 13. The reference number 7 designates the rear wall, and the reference number 9, the lower sealing flap of the folding box. The front wall 4 and the side wall 6 of the cardboard blank part 1 are located on both sides of the groove line 12 pressed into the cardboard. In the drawings, only one groove line 12 of the folding box and only one section of a bend line 13 is illustrated. It can, however, be seen that the bend lines 13 and the groove line 12 are exactly aligned with each other if the folding box blank (FIGS. 14, 16 and 18) is in a flat resting position; after gluing, erecting and closing of the folding box, said bend line 13 and groove line 12 form a continuous box edge (FIGS. 15, 17 and 19).

At all overlap spots existing at the box edges, of which only one is depicted in the drawings, the plastic foil material, consisting, for instance, of polyvinylchloride, is thinned-down to a fraction of its original foil thickness of approximately 200 to 400 μm in the zone of a thinned-down area 17, wherein the thickness within the thinned-down area 17 is smallest in the center, that is in the region of the groove line 12. The thinned-down area 17 is delimited by edges 34 on the sides, at which also the gluing between the cardboard blank part 1 and the foil blank part 3 can end. As is seen, the thinned-down area 17 extends across the entire overlap length of both blank parts 1 and 3.

The placement of the thinned-down area 17 can occur simultaneously with the placement of the bend line 13 in one single work process using procedures common for placement of bend lines, for instance by high frequency heating of the foil with simultaneous application of pressure. Bend lines produced in this manner yield particularly bendable soft bending edges.

The thinned-down area 17 compensates for stresses and consequent deformations occurring in the foil material at the overlap spots during folding, without which the cardboard material is stretched so that it tears at the edge overlap points. Residual stresses can occur particularly with thicker foils during folding in the transition zone between the thinned-down area 17 and the original foil material of the wall parts 14 and 16; this is because the bend line 13 has the desirable tendency to migrate somewhat towards the outside during the folding process, in order to form a practically stepless continuous box edge by alignment with the groove line 12.

It is necessary to avoid damage of the cardboard blank part at the boundary to the viewing area of the window opening 2 as well as possible warping in the area of the foil material of the wall parts 15 and 16 adjacent to the overlap spot. Therefore, to absorb such residual stresses, a line-shaped incision 48 is made in the foil blank part 3 in the embodiment form according to the FIG. 14, 15 at the juncture between the bend line 13 and the thinned-down area 17, said incision passing through the material thickness of the foil blank part 3. The incision 48 protrudes on both sides beyond the bend line 13 and extends parallel to the near edge of the cardboard blank part 1. The smaller the distance of the incision 48 from the mentioned neighboring edge of the cardboard blank part 1, the less prominent is the incision when the folding box is erected, as is shown in FIG. 15. In this case, because of the explained outward migration of the bend line 13 during the folding process, there is generated only a very small downwardly oriented opening (referred to the illustration according to FIG. 15) at the separation point at the box edge defined by the incision 48.

In the embodiment of the separation discernible from FIGS. 16 and 17, said separation is constructed as a circularly-shaped hole cutout 49, which separates the bend line 13 from the thinned-out area 17 and is only in outline overlapped by the cardboard blank part 1. The hole cutout 49 protrudes with approximately equal surface regions towards both sides beyond the bend line 13, as can be discerned from FIG. 16. It has been seen that a comparatively small diameter of the hole cutout 48 in relationship to the width of the thinned-out area 17 is sufficient in order to cause the above-mentioned additional stress equalization at the junction point between the bend line and the thinned-out area 17 to occur. Because of the small diameter, the hole cutout 49 is scarcely noticeable when the folding box is erected, as is made clear in FIG. 17.

In the embodiment according to FIGS. 18 and 19, the hole cutout constituting the separation is constructed in the shape of an ellipse 50, longer axis of which extends parallel to the neighboring edge of the cardboard blank part. In this case also the ellipse 50 protrudes with approximately equal surface areas to both sides of the bend line 13 and is only slightly overlapped by the cardboard blank part 1. The smaller diameter of the ellipse is made to be so small, that the box edge of the errected box constituted by the bend line 13 and the groove line 12 is only slightly interrupted. In the illustrated example, the largest diameter of the ellipse 50 is considerably smaller than the width of the thinned-out area 17, which, because of the increased scale in the FIGS. 14, 16 and 18, appears to be in any case wider than it is in actual practice.

The geometric versions of the hole cutout discernible from the FIGS. 16 and 18 are only given by way of preferred examples. Deviating geometric configurations such as, for instance, polygons are also possible if only an approximately symmetrical arrangement with reference to the bend line 13 and the groove line 12 is provided and the other indicated conditions are observed.

What is claimed is:

1. A folding box consisting of a first cut-to-size blank from non-transparent material, and a second cut-to-size blank from transparent stiff plastic foil, which extends over at least one box edge, a bending line provided in the plastic foil, second blank overlapping and being glued to the first cut-to-size blank on an inside surface of said first blank, wherein the overlap between the first and the second cut-to-size glanks exists also at at least one end of the bending line, and the bending line is continued in the first cut-to-size blank by a corresponding groove line, the bending line and groove line being approximately the same width and wherein a box edge of two box walls is formed by said bending line and said groove line, characterized in that the second blank is thinned-down to a fraction of the thickness of remaining portions of the second blank in an area along the bending line and directly adjacent to the bending line at the overlap between the first and the second blanks, the thinned-down area of the second blank extending over the entire width of the overlap.

2. Folding box according to claim 1, characterized in that each of the thinned-down areas has a cross-section remaining essentially constant over a length of the respective thinned-down area.

3. Folding box according to claim 1 or 2, characterized in that each of the thinned-down areas has a diminishing thickness starting from a side edge towards a center thereof, wherein the thickness in the region of the groove lines of the first blank is smallest.

4. Folding box according to claim 3, characterized in that the thinned-down areas are delimited on one side of said second blank in an arc-shaped fashion when viewed in cross-section.

5. Folding box according to claim 3, characterized in that the thinned-down areas are delimited on one side of said second blank, respectively, by at least two abutting inclined surfaces.

6. Folding box according to claim 3, characterized in that the thinned-down areas are delimited on one side of said second blank, respectively, by two external inclined surfaces and a central flat surface.

7. Folding box according to claim 3, characterized in that the thinned-down areas are delimited on one side of said second blank by flat surfaces arranged in a step-shaped manner.

8. Folding box according to claim 7 or 2, characterized in that, respectively, three parallel grooves are formed equally spaced within each of the thinned-down areas, a central one of said three grooves being arranged in the second blank in a direction of extension of said bend line associated with the respective thinned-down area.

9. Folding box according to claim 8, characterized in that the central groove adjoins directly the associated bend line, and the others of said three grooves bend, respectively, at inner ends thereof and unite with the cnetral groove at a junction point with the associated bend line.

10. Folding box according to claim 8, characterized in that the central groove is pressed up to a smaller foil residual thickness into the thinned-down foil than the others of said three grooves, which are pressed in up to an equal foil residual thickness.

11. Folding box according to claim 10 or 2, characterized in that a minimum thickness in each of the thinned-down areas amounts to approximately 100 μm with a thickness of the plastic foil used for the second blank of between 200 and 400 μm.

12. Folding box according to the claim 10, characterized in that the foil residual thickness at the central groove amounts to about one-third and the foil residual thickness at the two other grooves amounts to about two-thirds of a minimum thickness in each of the thinned-down areas.

13. Folding box according to claim 12 or 2, characterized in that the gluing, between the two blanks, ends approximately at a side edge of each of the thinned-down areas.

14. Folding box according to claim 8, characterized in that the gluing, between the two blanks, ends at said other two grooves.

15. Folding box according to 14 or 2, characterized in that the thinned-down areas are produced by an operation on one side of the plastic foil.

16. Folding box according to claim 15 or 2, characterized in that the thinned-down areas together with the bend line are produced by high frequency-/pressure application or by hot stamping.

17. Folding box according to claim 16 or 2, characterized in that each of the thinned-down areas comprises, respectively, one central strip covering the associated groove line of the first blank and adjoining the associated bend line of the second blank, which has a constant foil residual thickness throughout and which is adjoined in a continuous manner by transition surfaces which are concave and which reach up to side edges of the respective thinned-down area.

18. Folding box according to claim 17, characterized in that the central strip foil residual thickness is approximately 40 to 60 μm with a thickness of the plastics foil utilized for the second blank of between approximately 200 and 400 μm, while a width of the central strip amounts to approximately ⅓ to 1/6 of a width of each thinned-down area.

19. Folding box according to claim 18 or 2, characterized in that, respectively, one separation extending throughout the material thickness is provided across each bend adjacent to the respective thinned-down area in the second blank, said separation being essentially not overlapped by the first blank.

20. Folding box according to claim 19, characterized in that each separation is constituted as a line-shaped incision extending transversely to the bend line, said incision projecting on opposite sides of the bend line, a length of said incision being approximately equivalent to a width of the thinned-down area, and said incision extending parallel to an edge of the first blank in close proximity.

21. Folding box according to claim 19, characterized in that each separation is designed as a hole cutout, which projects on opposite sides of the bend line with approximately equal area regions and a width of said hole cutout corresponds, at most, to a width of the thinned-down area.

22. Folding box according to claim 21, characterized in that the hole cutout is designed to be circularly shaped in the second blank when the second blank is in a flat resting position.

23. Folding box according to claim 21, characterized in that the hole cutout is designed to be elliptically shaped in the second blank when the second blank is in a flat resting position, a longer axis of said elliptically shaped cutout extending parallel to an adjacent edge of the first blank.

24. Folding box according to claim 1, wherein said first blank has a plurality of groove lines and said second blank correspondingly has a plurality of bend lines and thinned-down areas.

* * * * *